US011398178B2

(12) United States Patent
Xuan et al.

(10) Patent No.: US 11,398,178 B2
(45) Date of Patent: Jul. 26, 2022

(54) PIXEL DRIVING CIRCUIT, METHOD, AND DISPLAY APPARATUS

(71) Applicant: BOE Technology Group Co., Ltd., Beijing (CN)

(72) Inventors: Minghua Xuan, Beijing (CN); Xiaochuan Chen, Beijing (CN); Han Yue, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 366 days.

(21) Appl. No.: 16/606,252

(22) PCT Filed: Oct. 23, 2018

(86) PCT No.: PCT/CN2018/111438
§ 371 (c)(1),
(2) Date: Oct. 18, 2019

(87) PCT Pub. No.: WO2020/082233
PCT Pub. Date: Apr. 30, 2020

(65) Prior Publication Data

US 2021/0366347 A1 Nov. 25, 2021

(51) Int. Cl.
*G09G 3/20* (2006.01)
*G09G 3/3233* (2016.01)

(52) U.S. Cl.
CPC ..... *G09G 3/2018* (2013.01); *G09G 3/3233* (2013.01); *G09G 2300/0426* (2013.01); *G09G 2300/0809* (2013.01); *G09G 2310/08* (2013.01)

(58) Field of Classification Search
CPC .. G09G 3/2018; G09G 3/2022; G09G 3/3233; G09G 3/3291; G09G 2300/0842; G09G 2300/0857
See application file for complete search history.

(56) References Cited

U.S. PATENT DOCUMENTS 9,626,926 B2 * 4/2017 Izawa ..... G09G 3/2022
2001/0002703 A1 * 6/2001 Koyama ..... G09G 3/3291 257/40
2008/0238855 A1 * 10/2008 Teranishi ..... G09G 3/2011 345/98
2008/0238867 A1 * 10/2008 Maeda ..... G09G 3/344 345/107

(Continued)

*Primary Examiner* — Priyank J Shah
(74) *Attorney, Agent, or Firm* — Intellectual Valley Law, P.C.

(57) ABSTRACT

The present application discloses a pixel driving circuit for generating a pixel luminance with multiple grayscale levels. The circuit includes a data input sub-circuit configured to input data signal once in each of multiple scans in one cycle time for displaying one frame of image. The circuit further includes a latch sub-circuit configured to latch a first voltage level in-phase with the data signal at the first node and a second voltage level out-of-phase with the data signal at a second node. Additionally, the circuit includes a data output sub-circuit configured to output a drive signal at a low voltage level under control of the first voltage level or at a high voltage level under control of the second voltage level. Furthermore, the circuit includes an emission-control sub-circuit configured to pass the drive signal to drive a light-emitting device in one partial time section of each of the multiple scans.

17 Claims, 4 Drawing Sheets

(56) References Cited

U.S. PATENT DOCUMENTS

2009/0096947 A1* 4/2009 Teranishi ..... G09G 3/3648
349/38
2017/0124968 A1* 5/2017 Shima ..... G02F 1/134309

* cited by examiner

| t1 | t2 | t3 | t4 | Gray |
|---|---|---|---|---|
| 0 | 0 | 0 | 0 | L0 |
| 1 | 0 | 0 | 0 | L1 |
| 0 | 1 | 0 | 0 | L2 |
| 1 | 1 | 0 | 0 | L3 |
| 0 | 0 | 1 | 0 | L4 |
| 1 | 0 | 1 | 0 | L5 |
| 0 | 1 | 1 | 0 | L6 |
| 1 | 1 | 1 | 0 | L7 |
| 0 | 0 | 0 | 1 | L8 |
| 1 | 0 | 0 | 1 | L9 |
| 0 | 1 | 0 | 1 | L10 |
| 1 | 1 | 0 | 1 | L11 |
| 0 | 0 | 1 | 1 | L12 |
| 1 | 0 | 1 | 1 | L13 |
| 0 | 1 | 1 | 1 | L14 |
| 1 | 1 | 1 | 1 | L15 |

FIG. 3

PIXEL DRIVING CIRCUIT, METHOD, AND DISPLAY APPARATUS

CROSS-REFERENCE TO RELATED APPLICATION

This application is a national stage application under 35 U.S.C. § 371 of International Application No. PCT/CN2018/111438, filed Oct. 23, 2018, the contents of which are incorporated by reference in the entirety.

TECHNICAL FIELD

The present invention relates to display technology, more particularly, to a pixel driving circuit providing multiple grayscale levels, a method for generating multiple grayscale levels for a pixel in a display panel, and a display apparatus having the same.

BACKGROUND

Wavelength of light emission of a light-emitting diode (LED) varies with a driving current flowing through it, leading to different LED color characteristics. Because of this issue, pulse waveform modulation (PWM) with a fixed current is typically used to drive the LED to generate different emission luminance and correspondingly different grayscale levels to maintain white balance and color accuracy of each LED emission. Traditional LEDs developed on silicon-substrate-based CMOS circuits, however, cannot be directly applied on glass-substrate-based circuits using the same PWM driving scheme since thin-film transistors (TFTs) on glass-substrate cannot produce switching frequency up to $10^8$~ $10^9$ Hz required for LEDs as the TFTs based on silicon CMOS circuits. Low-temperature polycrystalline silicon (LTPS) is synthesized at relatively low temperatures (~650° C. and lower) compared to traditional methods (above 900° C.) for forming the TFTs on glass panel display. But LTPS-based TFTs are typically characterized by a response frequency in an order of $10^6$ Hz.

SUMMARY

In an aspect, the present disclosure provides a pixel driving circuit for generating a pixel luminance with multiple grayscale levels. The pixel driving circuit includes a data input sub-circuit configured to control passing a data signal at one of at least a high data voltage and a low data voltage to a first node once in each of multiple scans in one cycle time for displaying one frame of image. Additionally, the pixel driving circuit includes a latch sub-circuit coupled to the first node, a first high-voltage terminal provided with a first high voltage level, a first low-voltage terminal provided with a first low voltage level, and a second node. The latch sub-circuit is configured to receive the data signal at the first node and latch a first voltage level being high or low at the first node in-phase with the data signal at the high data voltage or the low data voltage and latch a second voltage level being low or high at the second node out-of-phase with the data signal at the high data voltage or the low data voltage. Furthermore, the pixel driving circuit includes a data output sub-circuit coupled respectively to a second high-voltage terminal provided with a second high voltage level and a second low-voltage terminal provided with a second low voltage level, and configured to output a drive signal at the second low voltage level under control of the first voltage level or at the second high voltage level under control of the second voltage level. Moreover, the pixel driving circuit includes an emission-control sub-circuit configured to control passing the drive signal to drive a light-emitting device in one partial time section of each of the multiple scans.

Optionally, the data input sub-circuit includes a first switch transistor having a first electrode coupled to a data line provided with the data signal, a second electrode coupled to the first node, and a gate electrode coupled to a gate-control signal terminal.

Optionally, the latch sub-circuit includes a first P-type transistor, a first N-type transistor, a second P-type transistor, and a second N-type transistor. The first P-type transistor and the first N-type transistor have a first common gate electrode coupled to the second node. The second P-type transistor and the second N-type transistor have a second common gate electrode coupled to the first node. The first P-type transistor and the second P-type transistor have a first common source electrode coupled to the first high-voltage terminal. The first N-type transistor and the second N-type transistor have a second common source electrode coupled to the first low-voltage terminal.

Optionally, the data output sub-circuit includes a second switch transistor and a third switch transistor having a common second electrode as an output terminal. The second switch transistor has a gate electrode coupled to the second node and a first electrode coupled to a second high-voltage terminal. The third switch transistor has a gate electrode coupled to the first node and a first electrode coupled to the second low-voltage terminal.

Optionally, the emission-control sub-circuit includes a fourth switch transistor having a first electrode coupled to an output terminal of the data output sub-circuit, a second electrode coupled to an anode of the light-emitting device, and a gate electrode coupled to an emission-control signal terminal.

Optionally, the second high-voltage terminal is a common terminal as the first high-voltage terminal so that the second high-voltage level is the same as the first high-voltage level configured to be a turn-on voltage level for opening an N-type transistor or close a P-type transistor. The second low-voltage terminal is a common terminal as the first low-voltage terminal so that the second low-voltage level is the same as the first low-voltage level configured to be a turn-on voltage level for opening a P-type transistor or close an N-type transistor.

Optionally, the multiple scans are n scans. n is an integer greater than 1. Each partial time section in respective n scans is sequentially arranged from one unit of time to $2^{n-1}$ units of time of a binary multiplication series. A sum of n partial time sections of the respective n scans is smaller than one cycle time for displaying one frame of image.

Optionally, the drive signal generates a constant current or no current to drive a light emission from the light-emitting device or no light emission in the each partial time section of the respective n scans. The light emission is cumulated over the n scans in one cycle time for displaying one frame of image to produce a pixel luminance in one grayscale level of $2^n$ grayscale levels.

Optionally, the light-emitting device is a light-emitting diode. The data input sub-circuit, the latch sub-circuit, the data output sub-circuit, and the emission-control sub-circuit are based on a glass substrate.

In another aspect, the present disclosure provides a method of generating multiple grayscale levels for pixels in a display panel. The method includes inputting data signal having either a high data voltage or a low data voltage via a data line once in each of multiple scans in one cycle time for displaying one frame of image. Additionally, the method includes latching a first voltage level being high or low in-phase with the data signal being either the high data voltage or the low data voltage and a second voltage level being low or high out-of-phase with the data signal being either the high data voltage or the low data voltage. Furthermore, the method includes outputting a drive signal at a second low voltage level provided from a second low-voltage terminal under control of the first voltage level or a second high voltage level provided from a second high-voltage terminal under control of the second voltage level. Moreover, the method includes passing the drive signal to drive a light emission of a light-emitting device or no light emission in one partial time section of each of respective multiple scans.

Optionally, the step of inputting data signal includes inputting the high data voltage or the low data voltage in a first period to begin the each of the respective multiple scans through a first switch transistor. The first period is substantially shorter than the each of the respective multiple scans.

Optionally, inputting data signal further includes applying a gate-control signal at a transistor-turn-on voltage level within the first period to turn on the first switch transistor connected between the data line and a latch sub-circuit.

Optionally, the latch sub-circuit is configured to have a first P-type transistor and a first N-type transistor commonly coupled to a first latch node, and a second P-type transistor and a second N-type transistor commonly coupled to a second latch node. The first P-type transistor and the first N-type transistor have a first common gate electrode coupled to the second latch node. The second P-type transistor and the second N-type transistor have a second common gate electrode coupled to the first latch node. The first P-type transistor and the second P-type transistor have a first common source electrode coupled to a first high-voltage terminal provided with a first high voltage level. The first N-type transistor and the second N-type transistor have a second common source electrode coupled to a first low-voltage terminal provided with a first low voltage level.

Optionally, in each remaining period of the each of multiple scans, the step of latching includes setting the first voltage level at the first high voltage level to the first latch node and the second voltage level at the first low voltage level to the second latch node when the data signal is loaded with the high data voltage, or setting the first voltage level at the first low voltage level to the first latch node and the second voltage level at the first high voltage level to the second latch node when the data signal is loaded with the low data voltage.

Optionally, the step of outputting the drive signal includes outputting the second high voltage level of the second high-voltage terminal via a second switch transistor when the data signal is loaded with the high data voltage and outputting the second low voltage level of the second low-voltage terminal via a third switch transistor when the data signal is loaded with the low data voltage.

Optionally, the step of passing the drive signal includes applying an emission-control signal at a transistor-turn-on voltage level in one partial time section subsequent after the first period in the each of the multiple scans to turn on a fourth switch transistor connected to the light-emitting device to generate a constant current or no current to drive a light emission from the light-emitting device or no light emission.

Optionally, the multiple scans are n scans. n is an integer greater than 1. The method further includes setting the partial time section in each of consecutive n scans to be sequentially arranged from one unit of time to $2^{n-1}$ units of time of a binary multiplication series. The light emission is cumulated over the n scans in one cycle time for displaying one frame of image to produce a pixel luminance in one grayscale level of $2^n$ grayscale levels.

In yet another aspect, the present disclosure provides a display apparatus comprising a pixel driving circuit described herein per each of m×1 pixels in a display panel.

Optionally, m rows of the m×1 pixels are coupled respectively to m gate-control lines and m emission-control lines. Each gate-control line is provided with a gate-control signal at a transistor-turn-on voltage level in a first period at a beginning of each of n scans for loading a data signal either at a high data voltage or a low data voltage in one cycle time for displaying one frame of image. Each emission-control line is provided with an emission-control signal at the transistor-turn-on voltage level in one partial time section following the first period of each of the n scans.

Optionally, the each partial time section in respective n scans is sequentially arranged from one unit of time to $2^{n-1}$ units of time of a binary multiplication series to provide $2^n$ grayscale levels for each pixel based on the data signal loaded once in each of the n scans. Each partial time section of a same scan for different row of pixels is the same. The emission-control signal provided to an m-th emission-control line associated with a last row of the m×1 pixels in a corresponding partial time section in one of the n scans is turned off when the gate-control signal provided to the first gate-control line associated with a first row of the m×1 pixels in the first period of a next one of the n scans is turned on.

BRIEF DESCRIPTION OF THE FIGURES

The following drawings are merely examples for illustrative purposes according to various disclosed embodiments and are not intended to limit the scope of the present invention.

FIG. 3 is an exemplary table of multiple grayscale levels generated upon a binary data loaded in four different partial time sections of respective four scans per one frame according to an embodiment of the present disclosure.

DETAILED DESCRIPTION

The disclosure will now be described more specifically with reference to the following embodiments. It is to be noted that the following descriptions of some embodiments are presented herein for purpose of illustration and description only. It is not intended to be exhaustive or to be limited to the precise form disclosed.

LEDs used for glass-substrate-based display panel needs to use a fixed driving current under high voltage pulse to drive light emission to maintain white balance and color accuracy in each pixel in the display panel. While, the thin-film transistors (TFTs) in pixel circuits associated with the glass-substrate-based display panel are typically formed in a low-temperature polycrystalline silicon processing which yields no faster response switching rate in an order of $10^6$ Hz. It is hard to achieve pixel luminance above 10 different grayscale levels with these LTPS TFTs in a conventional pixel driving circuit.

Accordingly, the present disclosure provides, inter alia, a pixel driving circuit for generating multiple grayscale levels of 16 levels or higher, a method, and a display apparatus having the same that substantially obviate one or more of the problems due to limitations and disadvantages of the related art. In one aspect, the present disclosure provides a pixel driving circuit for producing pixel luminance with a grayscale variation in one of multiple grayscale levels controlled by a fixed driving current while loading data signal in multiple scans per one cycle time of displaying one frame of image.

Figure 1:
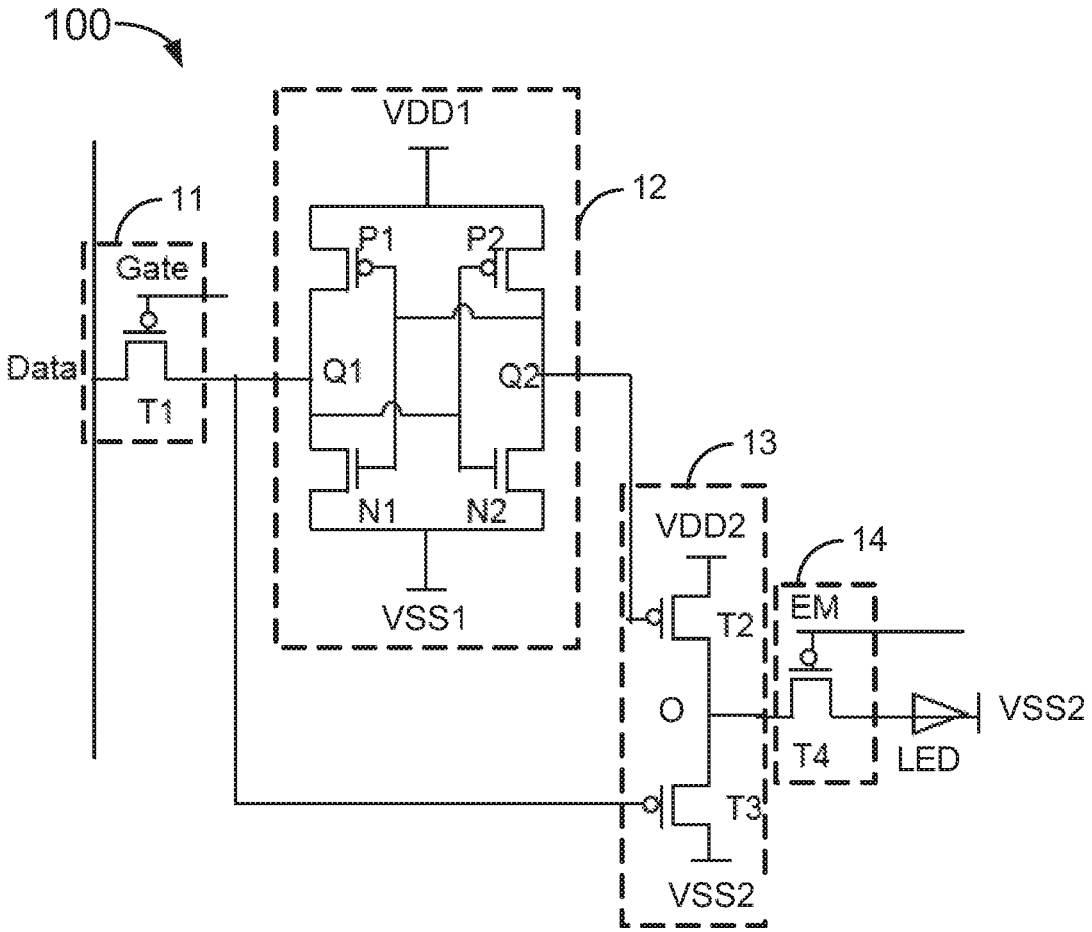
FIG. 1 is a block diagram of a pixel driving circuit according to some embodiments of the present disclosure.

FIG. 1 is a block diagram of a pixel driving circuit according to some embodiments of the present disclosure. Referring to FIG. 1, the pixel driving circuit 100 includes a data input sub-circuit 11 configured to control a data signal being passed from a data line Data to a first node of the circuit 100 once in each of multiple scans in one cycle time for displaying one frame of image. Optionally, the inputting of the data signal is controlled by a gate-driving signal from a gate line Gate. Optionally, the gate line connects all pixel driving circuits in one row of pixels of a display panel. Optionally, the data signal is loaded in n scans of one cycle time, n being an integer greater than 1. Optionally, n is a multiplication of 2. Optionally, n is 4 or greater. The pixel driving circuit 100 further includes a latch sub-circuit 12 coupled to the first node. Also, the latch sub-circuit 12 is coupled to a first high-voltage terminal VDD1 providing a first high voltage level and a first low-voltage terminal VSS1 providing a first low voltage level. The first node is also a first latch node Q1 of a latch sub-circuit 12. The latch sub-circuit 12 further includes a second node or a second latch node Q2 and is configured to receive the data signal inputted at the first node Q1 and latch a first voltage level being high or low at the first node Q1 in-phase with the data signal being at either a high data voltage or a low data voltage and a second voltage level being low or high at the second node Q2 out-of-phase with the data signal being at the high data voltage or the low data voltage. Optionally, the latch sub-circuit 12 is configured to be latched into either one of two states when the data signal at either the high data voltage or the low data voltage is loaded through inputting of the data signal from the data line Data via the data input sub-circuit 11 controlled by the gate-driving signal provided to a corresponding gate line Gate. Optionally, the gate-driving signal is a pulse to allow the data being loaded in a first period of each scan. Optionally, the first period is substantially short than total time span of each scan.

Referring to FIG. 1, the pixel driving circuit 100 additionally includes a data output sub-circuit 13 configured to output a drive signal at the low voltage level under control of the first voltage level at the first node Q1 to an output terminal O or output the drive signal at the high voltage level under control of the second voltage level at the second node Q2 to the output terminal O. Lastly, the pixel driving circuit 100 includes an emission-control sub-circuit 14 configured to pass the drive signal from the output terminal O to drive a light-emitting device (LED) to emit light in one partial time section of each of the multiple scans. Optionally, the drive signal, if passed by the emission-control sub-circuit 14, is applied to an anode of the LED (whose cathode is optionally connected to ground). Optionally, the one partial time section is controlled by an emission-control signal EM applied to a control terminal of the emission-control sub-circuit 14. In other words, the drive signal is able to drive the LED to have a light emission in the partial time section of each of the multiple scans if the drive signal is a high voltage pulse. Or the LED produces no light emission at all if the drive signal is a low voltage pulse. Optionally, for a data signal with at least two voltage levels including the high data voltage and the low data voltage loaded in n scans of one cycle time for displaying one frame of image, there are n different partial time sections respectively in the n scans controlled by the emission-control signal EM. For example, if either the high data voltage or the low data voltage is loaded from the data line Data to the latch sub-circuit 12 in 4 scans per one frame, the emission-control signal EM is set to have 4 partial time sections respectively for the 4 scans, namely, t1, t2, t3, and t4 to turn on the emission-control sub-circuit 14 to pass the drive signal.

Optionally, the data input sub-circuit 11 includes a first switch transistor T1 having a first electrode coupled to a data line Data provided with the data signal, a second electrode coupled to the first node Q1, and a gate electrode coupled to a gate-control signal terminal connected to a gate line Gate. Optionally, the gate-driving signal is a low voltage pulse applied from the gate line to the gate electrode to turn on the first transistor T1 in P-type. Optionally, the gate-driving signal is a high voltage pulse applied from the gate line to the gate electrode to turn on the first transistor T1 in N-type.

In an embodiment, the latch sub-circuit 12 includes a first P-type transistor P1, a first N-type transistor N1, a second P-type transistor P2, and a second N-type transistor N2 coupled each other to form a Static Random-Access Memory (SRAM). The first P-type transistor P1 and the first N-type transistor N1 have a first common gate electrode coupled to the second node Q2. The second P-type transistor P2 and the second N-type transistor N2 have a second common gate electrode coupled to the first node Q1. The first P-type transistor P1 and the second P-type transistor P2 have a first common source electrode coupled to the first high-voltage terminal VDD1. The first N-type transistor N1 and the second N-type transistor N2 have a second common source electrode coupled to the first low-voltage terminal VSS1. Optionally, the first high voltage terminal VDD1 supplies a fixed first high voltage level, which can be a turn-on voltage level for an N-type transistor. Optionally, the first low-voltage terminal VSS1 supplies a fixed first low voltage level, which can be a turn-on voltage level for a P-type transistor.

Optionally, the data output sub-circuit 13 includes a second switch transistor T2 and a third switch transistor T3 having a common second electrode as an output terminal O. The second switch transistor T2 has a gate electrode coupled to the second node Q2 and a first electrode coupled to a second high voltage terminal VDD2 provided with a second high voltage level. The third switch transistor T3 has a gate electrode coupled to the first node Q1 and a first electrode coupled to a second low-voltage terminal VSS2 provided with a second low voltage level. The output terminal O outputs either the second low voltage level under control of the first voltage level at the first node Q1 or the second high voltage level under control of the second voltage level at the second node Q2. Optionally, the second high-voltage terminal VDD2 is a common terminal as the first high-voltage terminal VDD1 so that the second high-voltage level is the same as the first high-voltage level configured to be a turn-on voltage level for opening an N-type transistor or close a P-type transistor. Optionally, the second low-voltage terminal VSS2 is a common terminal as the first low-voltage terminal VSS1 so that the second low-voltage level is the same as the first low-voltage level configured to be a turn-on voltage level for opening a P-type transistor or close an N-type transistor.

Optionally, the emission-control sub-circuit 14 includes a fourth switch transistor T4 having a first electrode coupled to an output terminal O of the data output sub-circuit 13, a second electrode coupled to an anode of the light-emitting device (LED), and a gate electrode coupled to an emission-control signal terminal to receive the emission-control signal EM. Optionally, the light-emitting device is a light-emitting diode. Optionally, all circuits include the data input sub-circuit, the latch sub-circuit, the data output sub-circuit, and the emission-control sub-circuit are based on a glass substrate.

Figure 2:
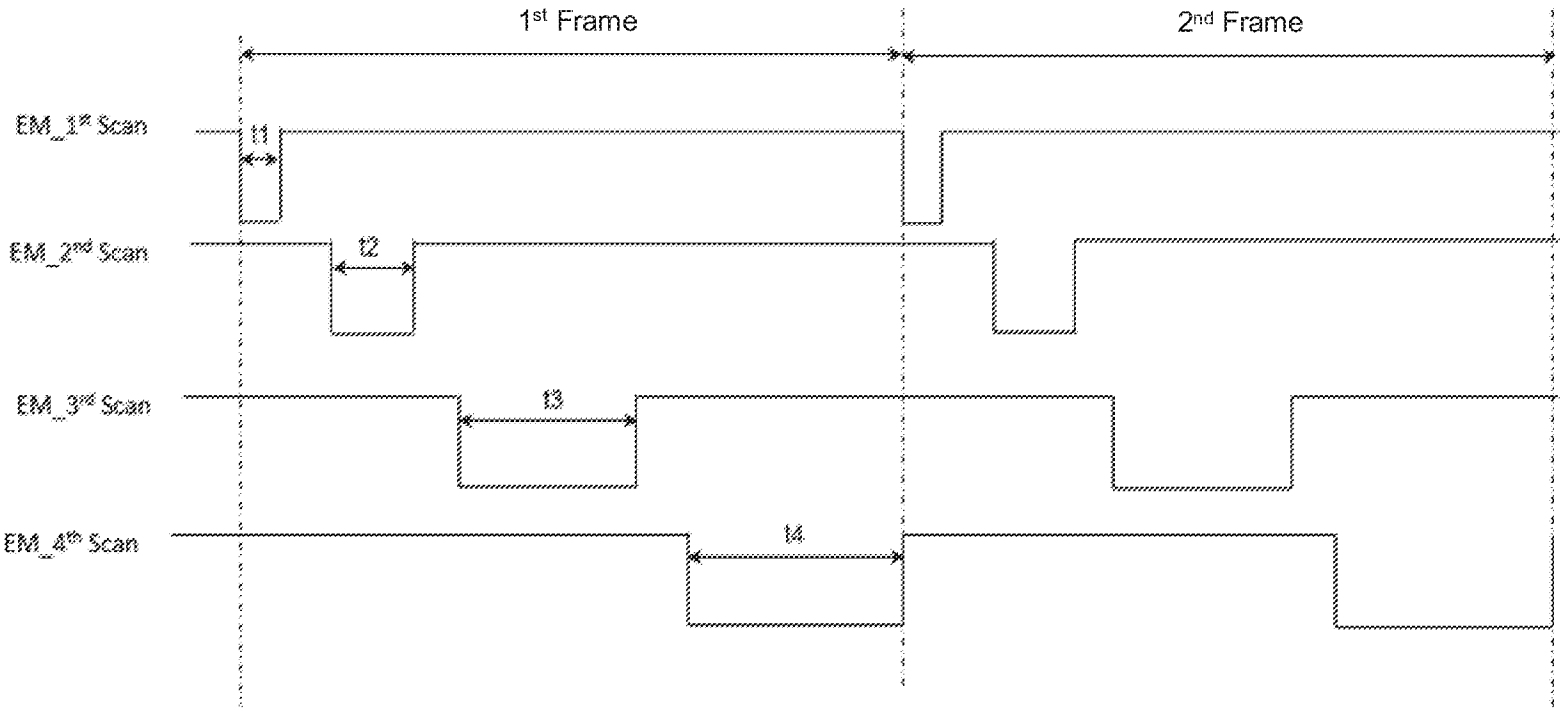
FIG. 2 is a timing diagram of multiple emission-control signals for respective scans in one cycle time of displaying one frame of image according to some embodiments of the present disclosure.

FIG. 2 is a timing diagram of multiple emission-control signals for operating the pixel driving circuit of FIG. 1 in respective scans in one cycle time of displaying one frame of image according to some embodiments of the present disclosure. Referring to both FIG. 1 and FIG. 2, the operation of the pixel driving circuit 100, assuming each switch transistor T1, or T2, or T3, or T4 is a P-type transistor, can be illustrated in each one of partial time sections of respective multiple scans in the one cycle time of displaying one frame of image. The one cycle time of displaying one frame of image is simply called one frame. In one example, one frame includes four scans. In other words, the data signal is loaded 4 times in one frame. In the first scan, the gate-driving signal from the gate line is provided with a low-voltage pulse to the gate electrode of the first switch transistor T1. Thus, the first switch transistor T1 is turned on to allow the data signal be inputted to the first node Q1. Optionally, using the gate-driving signal to control the inputting of the data signal can be executed within a first period of the first scan and the first period can be substantially shorter than the whole time span of the first scan.

In an example, the inputted data signal is assumed to be loaded with a high voltage pulse in the first period. The first node Q1 is then firstly set to the high voltage level of the data signal which is a level above a threshold voltage of a transistor. Accordingly, the second P-type transistor P2 is closed while the second N-type transistor N2 is turned on by the high voltage level pulse to allow the first low voltage level supplied to the first low-voltage terminal VSS1 to be written into the second node Q2 which is latched as a second voltage level. The first low voltage level at the second node Q2, accordingly, turns the first P-type transistor P1 on to allow the first high voltage level supplied to the first high voltage terminal VDD1 to be written into the first node Q1 which is latched as a first voltage level.

As the gate-driving signal is returned to a high voltage level (after the low-voltage pulse), the first voltage level at the first node Q1 is retained at the first high voltage level which is in-phase with the data signal being the high voltage pulse and the second voltage level at the second node Q2 is retained at the first low voltage level which is out-of-phase with the data signal being the high voltage pulse. In other words, whenever a high data voltage is loaded from the data line, the latch sub-circuit 12 is configured to latch a high voltage level at the first latch node Q1 and a low voltage level at the second latch node Q2. In this case, the first high voltage level at the first latch node Q1 keeps the third switch transistor T3 in closed state while the first low voltage level at the second latch node Q2 turns on the second switch transistor T2, allowing the second high voltage level to be written from the second high voltage terminal VDD2 to the output terminal O.

In the first partial time section t1 of the first scan, the emission-control signal EM is set to a low voltage level to turn on the fourth switch transistor T4 to pass the second high voltage level from the output terminal O to the anode of LED (whose cathode is optionally connected to the second low-voltage terminal VSS2). The high voltage serves as a drive signal to drive the LED to emit light within the first partial time section t1. Here, the first partial time section t1 is just part of the first scan in which the drive signal should be maintained at the second high voltage level, however, as the emission-control signal EM is provided as a low voltage pulse with a pulse width equal to the first partial time section t1, the emission time of the LED can be controlled to be substantially equal to the first partial time section t1.

In each other partial time sections t2, t3, or t4 of respective second, third, or fourth scan in the one cycle time of displaying one frame of image, the operation of the pixel driving circuit 100 would be the same. In a specific example, the four partial time sections t1, t2, t3, and t4 are arranged in a binary multiplication series, i.e., t1 is a unit time; t2 is $2\times t1$, 2 times of the unit time; t3 is $2\times t2=2^2\times t1$, $2^2$ times of unit time; and t4 is $2\times t3=2^3\times t1$, $2^3$ times of unit time. If each time the data signal is inputted as a high data voltage, the LED would emit light in each corresponding partial time section t2, t3, or t4, resulting in a longest emission time of $15\times t1$ which leads to a pixel luminance at a highest grayscale level of L15. If each time the data signal is inputted as a low data voltage, the LED would emit no light at all, i.e. with a shortest emission time of $0\times t1=0$, leading to a pixel luminance at a lowest grayscale level of L0. For any other options of loading either a high data voltage or a low data voltage in each of t1, t2, t3, and t4, other possible grayscale levels of total $2^4=16$ grayscale levels are produced. An exemplary table is shown in FIG. 3 with 16 grayscale levels from L0 to L15 generated upon a binary data loaded in four different partial time sections of respective four scans per one frame according to an embodiment of the present disclosure.

Referring to FIG. 3, t1~t4 are effective time sections using the emission-control signal EM to control light emission of the LED. Each time the LED emits light with a fixed luminance under a fixed current induced by the drive signal with a fixed high voltage level passed by the emission-control signal EM. The pixel grayscale level is thus defined by respective emission time under this fixed luminance. For example, in case that a high data voltage is loaded before t1 while a low data voltage is loaded before t2, t3, and t4, the LED emits light in one unit of time set by t1 while no light for other time sections t2, t3, and t4. This leads to a grayscale level L1 corresponding to an emission time in one unit of time. In another example, in case that a high data voltage is loaded before t1 and t2 but a low data voltage is loaded before t3 and t4, the LED emits light during t1 for one unit of time and during t2 for two units of time, and emits no light during t3 and t4. This leads to a grayscale level of L3 corresponding to an emission time in three units of time. By loading a binary data in 4 scans per one cycle time as well as controlling the emission-control signal EM, total 16 grayscale levels can be generated under a fixed driving current with different length of emission time. In general, by loading a bi-level data signal of either a high data voltage or a low data voltage in n scans per one cycle time, the pixel driving circuit 100 provided by the present disclosure is able to generate $2^n$ grayscale levels.

In a specific embodiment, a pixel luminance associated with each grayscale level can be calculated based on Gamma 2.2 conversion rule. In general, a pixel luminance of any grayscale level=(luminance of the grayscale level/luminance of grayscale level L15)$^{2.2}$×(luminance of grayscale level L15−luminance of grayscale level L0). In the embodiment, the above formula can be converted using emission time to replace the luminance. A pixel emission time of any grayscale level=(emission time of the grayscale level/emission time of grayscale level L15)$^{2.2}$×(emission time of grayscale level L15−emission time of grayscale level L0). Therefore, the emission time t1, t2, 3, or t4 is designed to set the emission-control signal EM for producing any one grayscale level of 16 grayscale levels. Optionally, a sum of these partial time sections t1, t2, t3, and t4 of respective 4 scans is no greater than one cycle time for displaying one frame of image. In the embodiment, the LED is driven by a fixed driving current so that its color of the light emission can be substantially fixed without drift. Once the emission time of each LED associated with each pixel is well controlled, the pixel luminance associated with each grayscale level can be accurately controlled.

In another aspect, the present disclosure provides a method of generating multiple grayscale levels for pixels in a display panel. The method includes inputting data signal having a bi-level of either a high data voltage or a low data voltage via a data line once in each of multiple scans in one cycle time for displaying one frame of image. Additionally, the method includes latching a first voltage level being high or low in-phase with the data signal being either the high data voltage or the low data voltage and a second voltage level being low or high out-of-phase with the data signal being either the high data voltage or the low data voltage. Furthermore, the method includes outputting a drive signal at a second low voltage level provided from a second low-voltage terminal under control of the first voltage level or a second high voltage level provided from a second high-voltage terminal under control of the second voltage level. Moreover, the method includes passing the drive signal to drive a light emission of a light-emitting device or no light emission in one partial time section of each of respective multiple scans.

In the embodiment, inputting data signal includes loading a high data voltage or a low data voltage in a first period to begin the each of the respective multiple scans through a first switch transistor. Optionally, the first period is substantially shorter than the each of the respective multiple scans. The first switch transistor is disposed between a data line supplied with data signal with either the high or the low data voltage and an input terminal of a latch sub-circuit. In the embodiment, inputting data signal further includes applying a gate-control signal as a voltage pulse at a transistor-turn-on voltage level within the first period to turn on the first switch transistor connected between the data line and the latch sub-circuit.

In an embodiment, the latch sub-circuit can be configured to have a first P-type transistor and a first N-type transistor commonly coupled to a first latch node, and a second P-type transistor and a second N-type transistor commonly coupled to a second latch node, the first P-type transistor and the first N-type transistor having a first common gate electrode coupled to the second latch node, the second P-type transistor and the second N-type transistor having a second common gate electrode coupled to the first latch node, the first P-type transistor and the second P-type transistor having a first common source electrode coupled to a first high voltage terminal supplied with a fixed voltage at a first high voltage level, the first N-type transistor and the second N-type transistor having a second common source electrode coupled to a first low-voltage terminal supplied with a fixed voltage at a first low voltage level or grounded level. FIG. 1 shows an example of such a latch sub-circuit 12 in a pixel driving circuit 100. The first latch node is the first node Q1 and the second latch node is the second node Q2 of the pixel driving circuit 100. The input terminal is also the first node Q1.

Optionally, the step of latching in the method further includes, in each remaining period of the each of multiple scans setting the first voltage level at the first high voltage level to the first latch node and the second voltage level at the first low voltage level to the second latch node when the data signal is loaded with the high data voltage or setting the first voltage level at the first low voltage level to the first latch node and the second voltage level at the first high voltage level to the second latch node when the data signal is loaded with the low data voltage.

Optionally, the step of outputting the drive signal in the method further includes outputting the second high voltage level to an output terminal when the high data voltage is loaded to the input terminal and outputting the second low voltage level to the output terminal when the low data voltage is loaded to the input terminal. Optionally, the step of passing the drive signal in the method includes applying an emission-control signal at a transistor-turn-on voltage level in one partial time section subsequently after the first period in the each of the multiple scans to turn on a fourth switch transistor connected to the light-emitting device.

Optionally, the method includes setting the multiple scans to be n scans, n being an integer greater than 1. The method further includes setting the partial time section in each of consecutive n scans to be sequentially arranged from one unit of time to $2^{n-1}$ units of time of a binary multiplication series. A sum of the n partial time sections of respective n scans is smaller than one cycle time for displaying one frame of image. Optionally, the method further includes using the drive signal to generate a constant current or no current to drive a light emission from the light-emitting device (LED) or no light emission in the each partial time section of the respective n scans depending on whether a high or low data voltage is loaded and stored in the latch sub-circuit. The light emission from the LED is cumulated over the n scans in one cycle time for displaying one frame of image to produce a pixel luminance in one grayscale level of $2^n$ grayscale levels.

Figure 4:
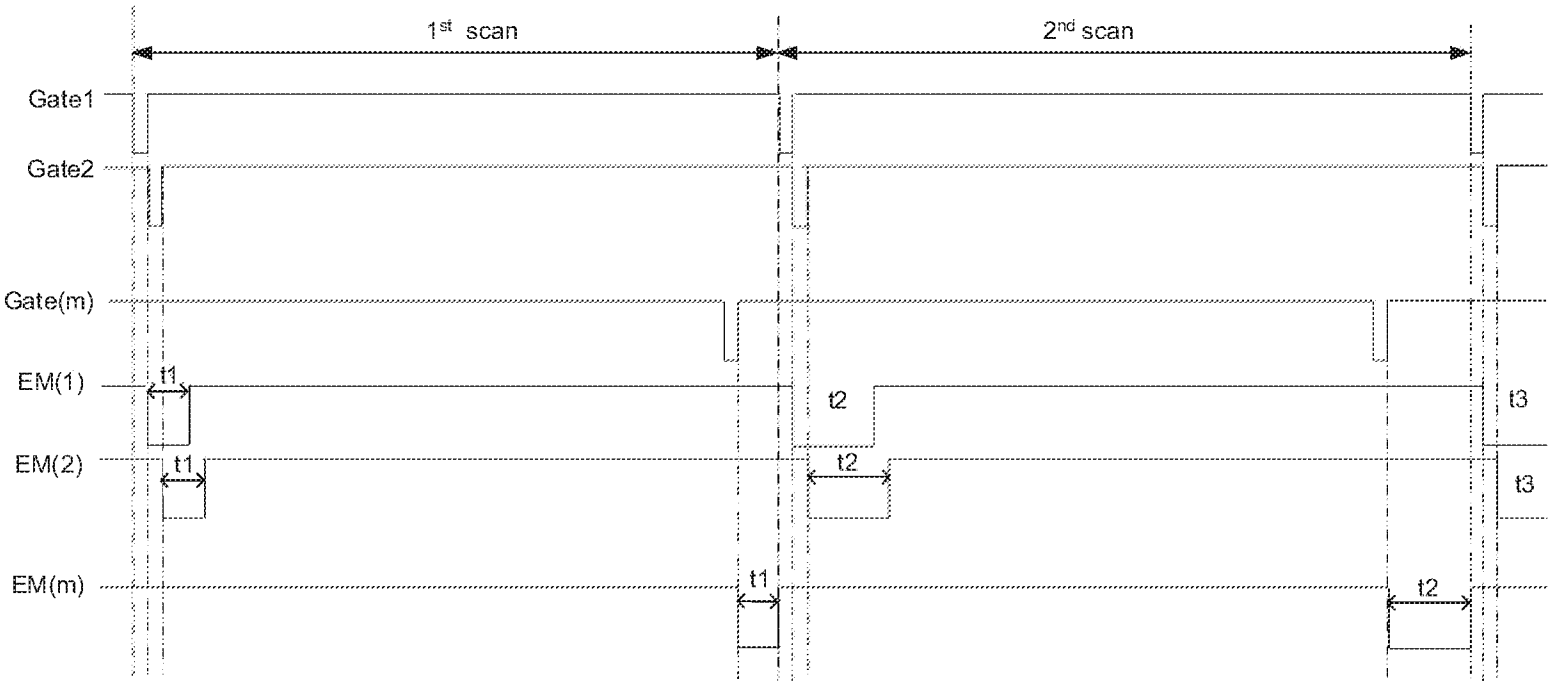
FIG. 4 is a timing diagram of operating the pixel driving circuit of FIG. 1 according to some embodiments of the present disclosure.

In yet another aspect, the present disclosure provides a display apparatus including a pixel driving circuit described herein per each of an array of m×1 pixels in a display panel. The array of m×1 pixels includes m rows of pixels or 1 columns of pixels. Optionally, the m rows of the m×1 pixels are coupled respectively to m gate-control lines, such as Gate1, Gate2, . . . Gate(m) and m emission-control lines, such as EM1, EM2, . . . EM(m). FIG. 4 is a timing diagram of operating the pixel driving circuit of FIG. 1 used for each of the array of m×1 pixels in the display panel according to some embodiments of the present disclosure. Each gate-control line Gate is provided with a gate-control signal at a transistor-turn-on voltage level in a first period at a beginning of each of n scans for loading a data signal with bi-levels of either a high data voltage or a low data voltage in one cycle time for displaying one frame of image, wherein each emission-control line is provided with an emission-control signal at the transistor-turn-on voltage level in one partial time section following the first period of each of the n scans.

Optionally, the each partial time section in respective n scans is sequentially arranged from one unit of time to $2^{n-1}$ units of time of a binary multiplication series to provide $2^n$ grayscale levels for each pixel based on the binary data signal loaded once in each of the n scans. Each partial time section of a same scan for each of m different rows of pixels is the same. Optionally, n is 4, i.e., for each frame the data is loaded in 4 scans, thereby leading to $2^4=16$ grayscale levels. Optionally, n is 8, i.e., for each frame the data is loaded in 8 scans, leading to $2^8=256$ grayscale levels. Optionally, n is 10 to load 10 times in one frame so that the display apparatus supports 1024 grayscale levels. Referring to FIG. 4, in a specific embodiment, the emission-control signal EM(m) provided to an m-th emission-control line associated with a last row of the m×1 pixels in a corresponding partial time section in one of the n scans is turned off when the gate-control signal provided to the first gate-control line Gate1 associated with a first row of the m×1 pixels in the first period of a next one of the n scans is turned on.

Optionally, the display apparatus is an organic light emitting diode display apparatus. Examples of appropriate display apparatuses include, but are not limited to, an electronic paper, a mobile phone, a tablet computer, a television, a monitor, a notebook computer, a digital album, a GPS, etc. In one example, the display apparatus is a smart watch.

The foregoing description of the embodiments of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like does not necessarily limit the claim scope to a specific embodiment, and the reference to exemplary embodiments of the invention does not imply a limitation on the invention, and no such limitation is to be inferred. The invention is limited only by the spirit and scope of the appended claims. Moreover, these claims may refer to use "first", "second", etc. following with noun or element. Such terms should be understood as a nomenclature and should not be construed as giving the limitation on the number of the elements modified by such nomenclature unless specific number has been given. Any advantages and benefits described may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. A display apparatus comprising a pixel driving circuit per each of m×1 pixels in a display panel, wherein the pixel driving circuit for generating a pixel luminance with multiple grayscale levels comprises:

a data input sub-circuit configured to control passing a data signal at one of at least a high data voltage and a low data voltage to a first node once in each of multiple scans in one cycle time for displaying one frame of image;

a latch sub-circuit coupled to the first node, a first high-voltage terminal provided with a first high voltage level, a low-voltage terminal provided with a first low voltage level, and a second node, and configured to receive the data signal at the first node and latch a first voltage level being high or low at the first node in-phase with the data signal at the high data voltage or the low data voltage and latch a second voltage level being low or high at the second node out-of-phase with the data signal at the high data voltage or the low data voltage;

a data output sub-circuit coupled respectively to a second high-voltage terminal provided with a second high voltage level and a second low-voltage terminal provided with a second low voltage level, and configured to output a drive signal at the second low voltage level under control of the first voltage level or at the second high voltage level under control of the second voltage level; and an emission-control sub-circuit configured to control passing the drive signal to drive a light-emitting device in one partial time section of each of the multiple scans;

wherein the m rows of the m×1 pixels are coupled respectively to m gate-control lines and m emission-control lines, wherein each gate-control line is provided with a gate-control signal at a transistor-turn-on voltage level in a first period at a beginning of each of n scans for loading a data signal either at a high data voltage or a low data voltage in one cycle time for displaying one frame of image, wherein each emission-control line is provided with an emission-control signal at the transistor-turn-on voltage level in one partial time section following the first period of each of the n scans; and the each partial time section in respective n scans is sequentially arranged from one unit of time to $2^{n-1}$ units of time of a binary multiplication series to provide $2^n$ grayscale levels for each pixel based on the data signal loaded once in each of the n scans; wherein each partial time section of a same scan for different row of pixels is the same; wherein the emission-control signal provided to a m-th emission-control line associated with a last row of the m×1 pixels in a corresponding partial time section in one of the n scans is turned off when the gate-control signal provided to the first gate-control line associated with a first row of the m×1 pixels in the first period of a next one of the n scans is turned on.

2. The display apparatus of claim 1, wherein the data input sub-circuit comprises a first switch transistor having a first electrode coupled to a data line provided with the data signal, a second electrode coupled to the first node, and a gate electrode coupled to a gate-control signal terminal.

3. The display apparatus of claim 1, wherein the latch sub-circuit comprises a first P-type transistor, a first N-type transistor, a second P-type transistor, and a second N-type transistor, the first P-type transistor and the first N-type transistor having a first common gate electrode coupled to the second node, the second P-type transistor and the second N-type transistor having a second common gate electrode coupled to the first node, the first P-type transistor and the second P-type transistor having a first common source electrode coupled to the first high-voltage terminal, the first N-type transistor and the second N-type transistor having a second common source electrode coupled to the first low-voltage terminal.

4. The display apparatus of claim 1, wherein the data output sub-circuit comprises a second switch transistor and a third switch transistor having a common second electrode as an output terminal, the second switch transistor having a gate electrode coupled to the second node and a first electrode coupled to a second high-voltage terminal, the third switch transistor having a gate electrode coupled to the first node and a first electrode coupled to the second low-voltage terminal.

5. The display apparatus of claim 1, wherein the emission-control sub-circuit comprises a fourth switch transistor having a first electrode coupled to an output terminal of the data output sub-circuit, a second electrode coupled to an anode of the light-emitting device, and a gate electrode coupled to an emission-control signal terminal.

6. The display apparatus of claim 1, wherein the second high-voltage terminal is a common terminal as the first high-voltage terminal so that the second high-voltage level is the same as the first high-voltage level configured to be a turn-on voltage level for opening an N-type transistor or close a P-type transistor; the second low-voltage terminal is a common terminal as the first low-voltage terminal so that the second low-voltage level is the same as the first low-voltage level configured to be a turn-on voltage level for opening a P-type transistor or close an N-type transistor.

7. The display apparatus of claim 1, wherein the multiple scans are n scans, n being an integer greater than 1, wherein each partial time section in respective n scans is sequentially arranged from one unit of time to $2^{n-1}$ units of time of a binary multiplication series, wherein a sum of n partial time sections of the respective n scans is smaller than one cycle time for displaying one frame of image.

8. The display apparatus of claim 7, wherein the drive signal generates a constant current or no current to drive a light emission from the light-emitting device or no light emission in the each partial time section of the respective n scans, wherein the light emission is cumulated over the n scans in one cycle time for displaying one frame of image to produce a pixel luminance in one grayscale level of $2^n$ grayscale levels.

9. The display apparatus of claim 1, wherein the light-emitting device is a light-emitting diode; the data input sub-circuit, the latch sub-circuit, the data output sub-circuit, and the emission-control sub-circuit are based on a glass substrate.

10. A method of generating multiple grayscale levels for pixels in a display panel comprising:

inputting data signal having either a high data voltage or a low data voltage via a data line once in each of multiple scans in one cycle time for displaying one frame of image;

latching a first voltage level being high or low in-phase with the data signal being either the high data voltage or the low data voltage and a second voltage level being low or high out-of-phase with the data signal being either the high data voltage or the low data voltage;

outputting a drive signal at a second low voltage level provided from a second low-voltage terminal under control of the first voltage level or a second high voltage level provided from a second high-voltage terminal under control of the second voltage level;

passing the drive signal to drive a light emission of a light-emitting device or no light emission in one partial time section of each of respective multiple scans;

wherein the display panel comprises a pixel driving circuit per each of m×1 pixels;

the method further comprises:

respectively coupling the m rows of the m×1 pixels to m gate-control lines and m emission-control lines, wherein each gate-control line is provided with a gate-control signal at a transistor-turn-on voltage level in a first period at a beginning of each of n scans for loading a data signal either at a high data voltage or a low data voltage in one cycle time for displaying one frame of image, wherein each emission-control line is provided with an emission-control signal at the transistor-turn-on voltage level in one partial time section following the first period of each of the n scans; and the each partial time section in respective n scans is sequentially arranged from one unit of time to $2^{n-1}$ units of time of a binary multiplication series to provide $2^n$ grayscale levels for each pixel based on the data signal loaded once in each of the n scans; wherein each partial time section of a same scan for different row of pixels is the same; wherein the emission-control signal provided to a m-th emission-control line associated with a last row of the m×1 pixels in a corresponding partial time section in one of the n scans is turned off when the gate-control signal provided to the first gate-control line associated with a first row of the m×1 pixels in the first period of a next one of the n scans is turned on.

11. The method of claim 10, wherein inputting data signal comprises inputting the high data voltage or the low data voltage in a first period to begin the each of the respective multiple scans through a first switch transistor, wherein the first period is substantially shorter than the each of the respective multiple scans.

12. The method of claim 11, wherein inputting data signal further comprises applying a gate-control signal at a transistor-turn-on voltage level within the first period to turn on the first switch transistor connected between the data line and a latch sub-circuit.

13. The method of claim 12, wherein the latch sub-circuit is configured to have a first P-type transistor and a first N-type transistor commonly coupled to a first latch node, and a second P-type transistor and a second N-type transistor commonly coupled to a second latch node, the first P-type transistor and the first N-type transistor having a first common gate electrode coupled to the second latch node, the second P-type transistor and the second N-type transistor having a second common gate electrode coupled to the first latch node, the first P-type transistor and the second P-type transistor having a first common source electrode coupled to a first high-voltage terminal provided with a first high voltage level, the first N-type transistor and the second N-type transistor having a second common source electrode coupled to a first low-voltage terminal provided with a first low voltage level.

14. The method of claim 13, wherein latching comprises, in each remaining period of the each of multiple scans, setting the first voltage level at the first high voltage level to the first latch node and the second voltage level at the first low voltage level to the second latch node when the data signal is loaded with the high data voltage, or setting the first voltage level at the first low voltage level to the first latch node and the second voltage level at the first high voltage level to the second latch node when the data signal is loaded with the low data voltage.

15. The method of claim 11, wherein outputting the drive signal comprises outputting the second high voltage level of the second high-voltage terminal via a second switch transistor when the data signal is loaded with the high data voltage and outputting the second low voltage level of the second low-voltage terminal via a third switch transistor when the data signal is loaded with the low data voltage.

16. The method of claim 15, wherein passing the drive signal comprises applying an emission-control signal at a transistor-turn-on voltage level in one partial time section subsequent after the first period in the each of the multiple scans to turn on a fourth switch transistor connected to the light-emitting device to generate a constant current or no current to drive a light emission from the light-emitting device or no light emission.

17. The method of claim 14, wherein the multiple scans are n scans, n being an integer greater than 1, further comprising setting the partial time section in each of consecutive n scans to be sequentially arranged from one unit of time to $2^{n-1}$ units of time of a binary multiplication series; wherein the light emission is cumulated over the n scans in one cycle time for displaying one frame of image to produce a pixel luminance in one grayscale level of $2^n$ grayscale levels.

* * * * *